US006554215B1

(12) United States Patent
Schultz et al.

(10) Patent No.: US 6,554,215 B1
(45) Date of Patent: Apr. 29, 2003

(54) WEAR PROTECTION FOR TABLES FOR CENTRIFUGAL IMPACT CRUSHERS

(75) Inventors: Michael E. Schultz, Troutdale, OR (US); Claude H. Reber, Vancouver, WA (US); Harold E. Munsell, Jr., Vancouver, WA (US)

(73) Assignee: Cedarapids Inc., Cedar Rapids, IA (US)

( * ) Notice: Subject to any disclaimer, the term of this patent is extended or adjusted under 35 U.S.C. 154(b) by 0 days.

(21) Appl. No.: 09/704,341

(22) Filed: Oct. 31, 2000

(51) Int. Cl.[7] ..... B02C 19/00
(52) U.S. Cl. ..... 241/275
(58) Field of Search ..... 241/275, 300

(56) References Cited

U.S. PATENT DOCUMENTS 4,690,341 A * 9/1987 Hise et al. ..... 241/275
4,940,188 A * 7/1990 Rodriguez et al. ..... 241/275

* cited by examiner

*Primary Examiner*—Mark Rosenbaum
(74) *Attorney, Agent, or Firm*—Abelman, Frayne & Schwab

(57) ABSTRACT

A table assembly for a vertical shaft impact crusher includes an impeller having rods embedded vertically in it next to its leading edge. The rods are made from a material which is harder than the material that the body of the impeller is made from. The rods are located where wear is most prevalent. In most situations this would be at both sides of the impeller, but it might be at the center as well. The top surface of the table between impellers is covered with bottom wear plates. The bottom wear plates have raised portions immediately adjacent to the leading edge of the impellers and sloped ramps between the raised portions and the rest of the wear plates.

20 Claims, 4 Drawing Sheets

WEAR PROTECTION FOR TABLES FOR CENTRIFUGAL IMPACT CRUSHERS

BACKGROUND OF THE INVENTION

1. Field of the Invention

This invention relates to a system for protecting wear parts in a vertical shaft centrifugal impact crusher.

2. Description of the Related Art

Material is crushed in a vertical shaft centrifugal impact crusher by being thrown off of a rotating table against anvils which are located around the periphery of the table. The table has impellers on it at spaced-apart locations about its periphery which cause the material to leave the table in the direction which will maximize fracture of the material as it strikes the anvils. The material being crushed is often quite abrasive and it causes considerable wear of the table parts, particularly the impellers. In addition, because the table parts become caked with dust from the material being crushed it often is quite difficult to remove them for replacement when they become worn. Some vertical shaft impact crushers employ an open table design where the impellers are releasably attached to mounting brackets which are permanently attached to the top of a single horizontal table. Other vertical shaft impact crushers employ a closed table design where impellers are sandwiched between upper and lower table elements. Closed table crushers have impellers which are less subject to wear than open table crushers, but it is much more difficult to replace them. Thus, the increased labor costs and costs of down time when replacement is necessary offsets the longer wear of the impellers.

Attempts have been made to protect the wear parts in vertical shaft impact crushers in the past. Britzke, et al., U.S. Pat. No. 5,954,282 disclose a crusher impeller that has horizontal bores at selected locations on its face. Tungsten carbide rods are then placed in these bores. However, this provides very localized protection and the impeller body will still wear between and around the rods. In addition, the rods can become displaced in the harsh environment in which these devices operate.

Britzke, et al. also disclose wear plates which cover the table between adjacent impellers. These wear plates not only protect the top surface of the table, but they have ramps that are located immediately in front of the associated impeller to cause the material to be thrown up onto the center part of the impeller face. While this does somewhat solve the problem of wear being concentrated near the bottom of impeller it creates a dead space above the ramp and even wear is still not obtained.

SUMMARY OF THE INVENTION

In one aspect of the subject invention, increased life is provided for the wear parts of an open table vertical shaft impact crusher by embedding in each impeller one or more rods which are made from material which is harder and more wear-resistant than the material the impellers are made from. The rods are oriented vertically and are located near the leading edge of the impeller at locations where the most wear occurs. Typically this would be near each side of the impeller, but one might be placed at the center as well. In a preferred embodiment of the invention the rods are tungsten carbide.

In another aspect of the invention, a bottom wear plate covers the upper surface of the table between the leading edge of each impeller and the back of the mounting bracket of an adjacent impeller. The bottom wear plate has a raised portion which is immediately adjacent to the leading edge of the impeller. A sloped ramp extends between the raised portion and the rest of the bottom wear plate.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
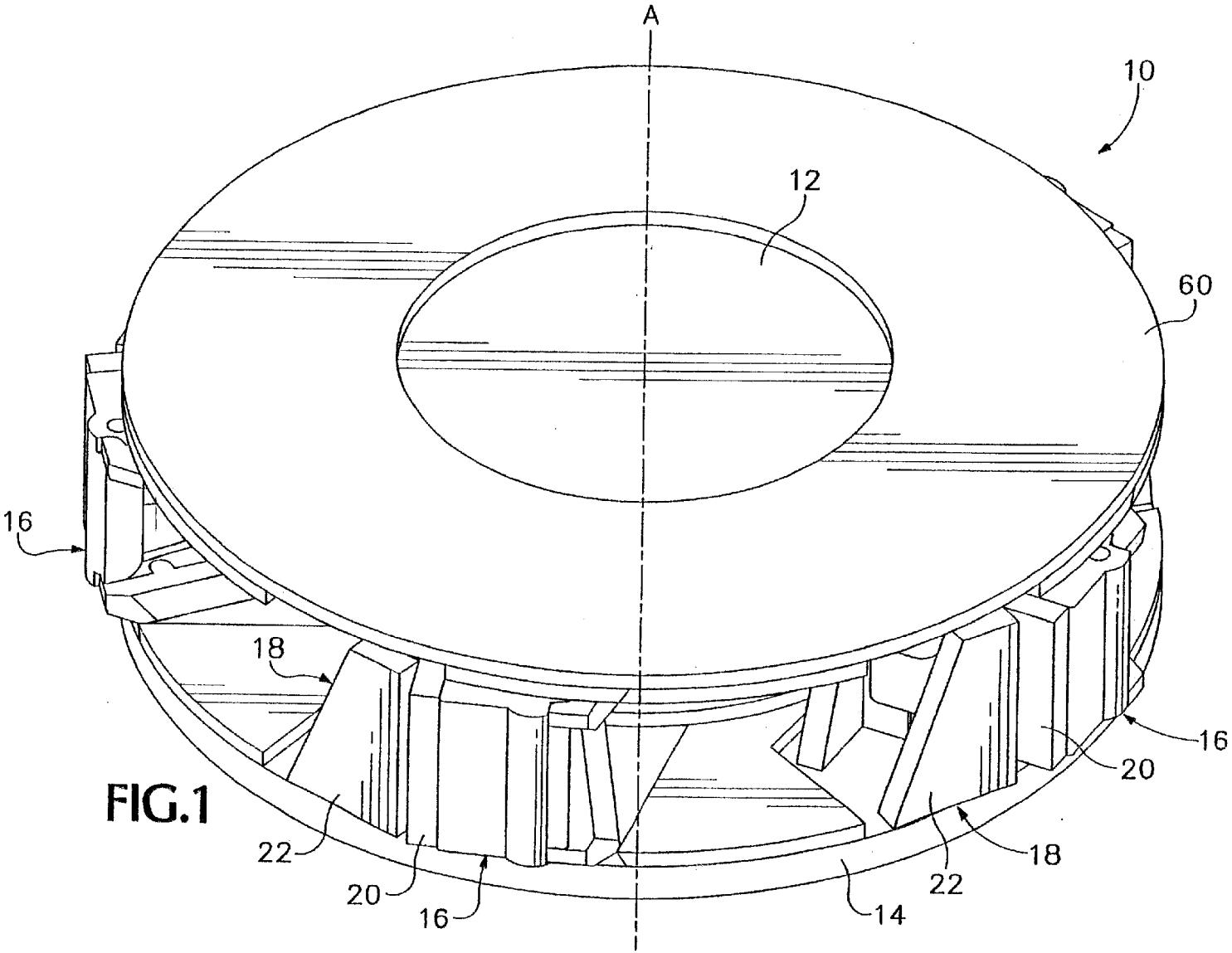
FIG. 1 is a perspective view of the table assembly embodying the subject invention.
Figure 2:
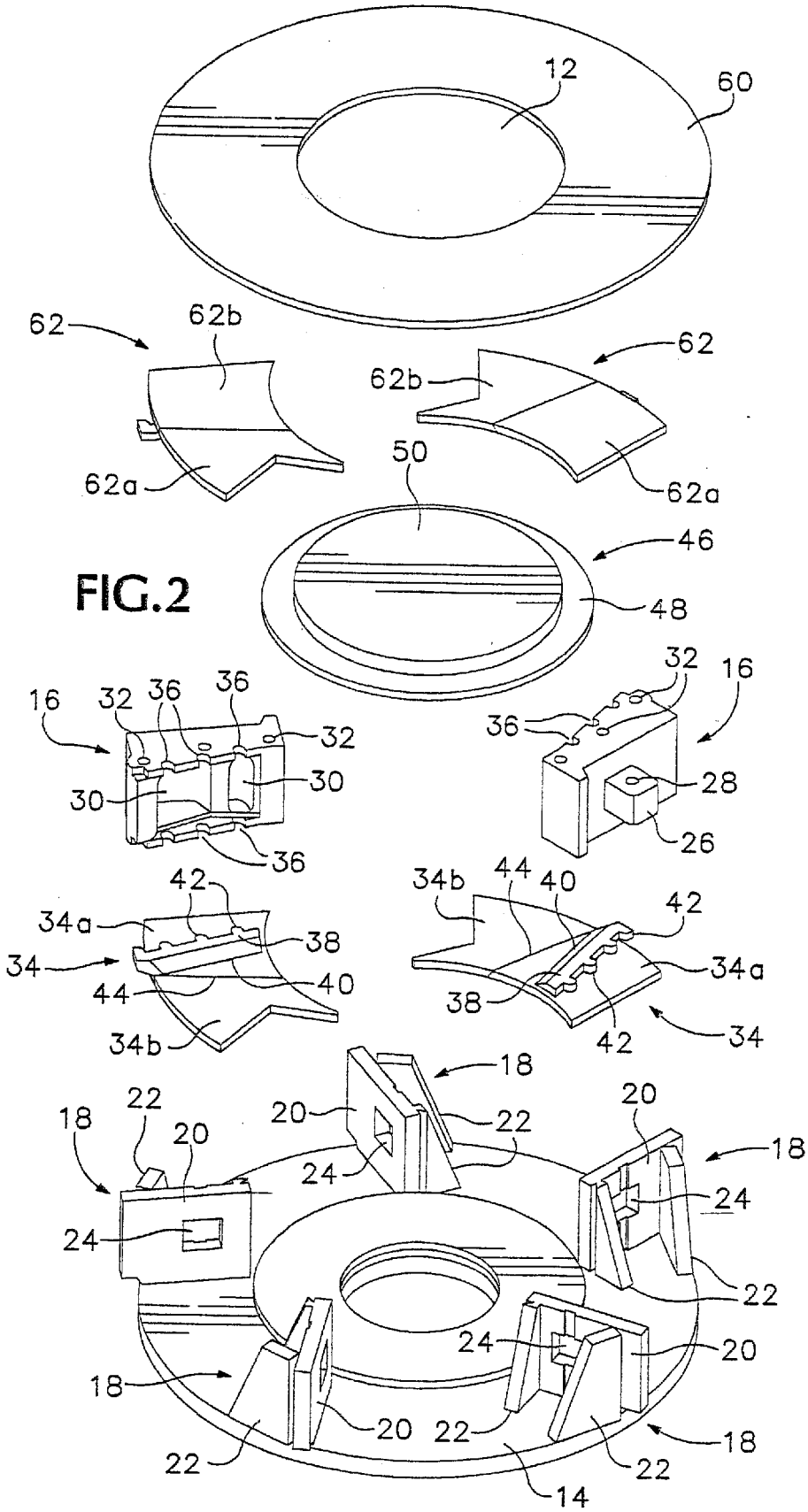
FIG. 2 is an exploded pictorial view of the table assembly of the subject invention.
Figure 3:
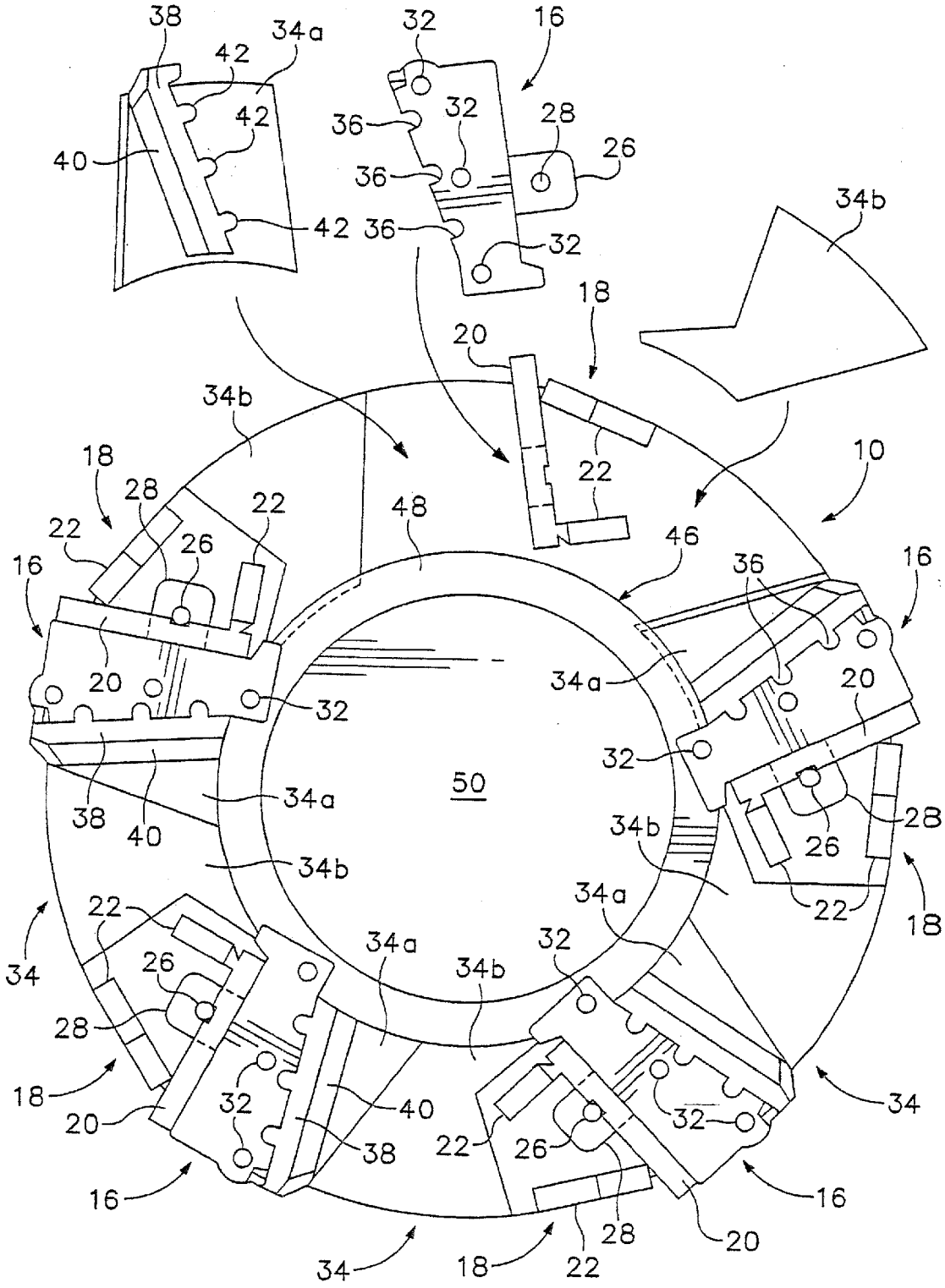
FIG. 3 is an exploded plan view of the table assembly of the subject invention, at an enlarged scale.
Figure 4:
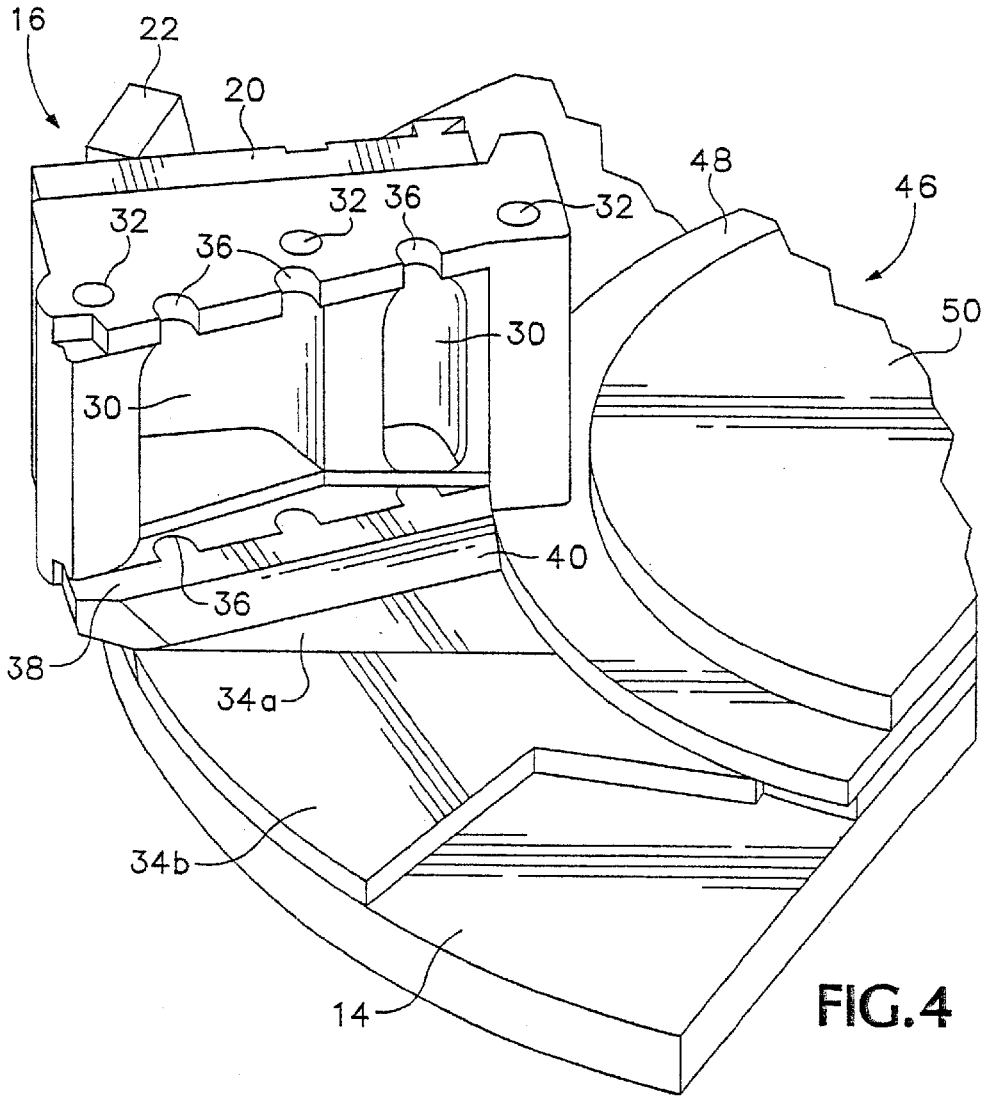
FIG. 4 is a perspective view showing the impeller and bottom wear plates above the subject invention, at a still larger scale.

Referring to the drawings, a table assembly 10 is located within a cylindrical case (not shown) and rotated about a central axis A by a motor (not shown). Material to be crushed is deposited onto the table assembly through an opening 12 and falls onto a table 14. Rotation of the table assembly creates a centrifugal force which throws the material off of the table where it impacts anvils (not shown) mounted on the inner wall of the case around the periphery of the table 14. When the material strikes the anvils it is fractured into smaller pieces. The crushed material then drops to the bottom of the case where it is removed. In order to direct the material as it leaves the table so that it strikes the anvils at the correct angle to maximize the force of the impact, impellers 16 are mounted on the table at spaced-apart intervals.

In order to permit the impeller 16 to be easily replaced, a mounting bracket 18 is attached to the table at the location of each impeller. The mounting bracket includes a mounting plate 20, which extends radially across the table, and two upright supports 22 which are attached to the back of a mounting plate 20 and the table 14. The mounting plate has a rectangular opening 24 located in it and the impeller has a rectangular cross-sectioned tab 26 extending from its rear face which extends through the opening 24. A pin (not shown) extends through a hole 28 in the tab to secure the impeller in place against the mounting plate 20.

In order to reduce wear of the impeller, cavities 30 are located in its leading edge, which is where it engages the material being crushed. These cavities fill up with the material being crushed so that the material becomes a wear surface. To further reduce wear, elongate rods 32, which are made from a material that is harder and more wear-resistant than the material the body of the impeller is made from, are embedded in the impellers. This is accomplished by casting the impellers around the rods. Impellers of this type are cast iron and to increase their hardness the iron has a high chrome content. The material often used for impellers is 28% chrome cast iron. A preferred material for the rods 32 is tungsten carbide. Grade 368 tungsten carbide has been found to work well. The rods are placed vertically in the impellers near their leading edge. Preferably the rods are located at the place on the impeller which experience the most wear. Typically this would be at both sides, but in many cases it may be helpful to have one located near the center of the impeller also. Located at the leading edge of each impeller, at its top and its bottom, are a series of semicircular cutouts 36, the purpose of which will be explained later.

Bottom wear plates 34 protect the top surface of the table between the leading edge of one impeller 16 and the trailing edge of the mounting bracket of an adjacent impeller. In the embodiment illustrated, each bottom wear plate is divided into a first bottom section 34*a* and a second bottom section 34*b*. A portion of the first bottom section 34*a* is located under the associated impeller 16. The portion 38 of the first bottom section that is immediately adjacent to the leading edge of the impeller 16 is raised above the rest of the wear plate and a sloped ramp 40 extends between this raised portion 38 and the remainder of the wear plate. The edge of the raised portion 38 has a series of projecting semicircular tabs 42 which fit into the cutouts 36 at the lower leading edge of the impeller. Thus, the impeller holds the first bottom section down on the table and prevents the first bottom section from moving radially outwardly when the table is rotated, and no fasteners are required to keep it in place. The intersection 44 between the first bottom section 34*a* and the second bottom section 34*b* is angled with respect to a radial line on the table and is sloped with respect to the vertical so that the two bottom sections slightly overlap one another. In addition, the edge of the second bottom section 34*b* fits behind the mounting bracket 18. While the geometry of the first and second bottom sections index the section, the second section can be removed and replaced without removing the first section, and the second section needs to be fastened to the table with mechanical fasteners (not shown). The raised portion 38 and ramp 40 force the material being crushed up onto the face of the impeller to provide more uniform impeller wear.

A center liner 46 is located at the center of the table. The center liner is attached to the table by conventional means (not shown). The outer periphery 48 of the center liner overlaps the edges of the bottom wear plates 34 and its upper surface is co-planer with the raised portions 38. The center liner has a raised center section 58.

If desired, the table can be covered with a cover plate 60 which is located on top of the impellers 16. The cover plate is attached to the table by conventional means, not shown. If a cover plate 60 is utilized, top wear plate 62 can be attached to its underside to protect it from wear. Like the bottom wear plates, the top wear plates are divided into a first top section 62*a* and a second top section 62*b*. A portion of the first top section 62*a* is located under the associated impeller 16. Both top sections are attached to the cover plate 60 by means of fasteners (not shown).

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A table assembly for a vertical shaft centrifugal impact crusher comprising:

(a) a rotatable table having a plurality of impeller mounting brackets mounted thereon at spaced-apart locations;

(b) a plurality of impellers each having a leading edge which engages material being crushed, each leading edge having a cut-out portion; and a trailing edge which contacts an associated mounting bracket;

(c) an attachment mechanism associated with each said impeller which attaches said impeller releasably to one of said mounting brackets;

(d) a plurality of bottom wear plates which cover the exposed portions of said table between said impellers;

(e) raised portions of said bottom wear plates which are located immediately adjacent to the leading edge of said impellers, said raised portions being raised above the remainder of said bottom wear plates, wherein each raised portion includes:

a tab which engages a respective cut-out portion of a respective leading edge, thereby causing each impeller associated with each respective leading edge to hold down onto the table a respective bottom wear plate, associated with the respective raised portion, as the table is rotated; and (f) sloped ramps which extend between said raised portions and the remainder of said wear plates.

2. The table assembly of claim 1 wherein said bottom wear plates are separated into first bottom sections which are held in place by an associated impeller and second bottom sections which are held in place at least partially by said first bottom sections and can be removed without removing said first bottom sections.

3. The table assembly of claim 2 including:

(a) a table cover which is located above said impeller and encloses said table; and (b) a plurality of top wear plates which cover said table cover.

4. The table assembly of claim 3 wherein said top wear plates are separated into first top sections which are held in place by an associated impeller and second top sections which are held in place at least partially by said first top sections and can be removed without removing said first top sections.

5. The table assembly of claim 1 including:

(a) a table cover which is located above said impellers and encloses said table; and (b) a plurality of top wear plates which cover said table cover.

6. The table assembly of claim 5 wherein said top wear plates are separated into first top sections which are held in place by an associated impeller and second top sections which are held in place at least partially by said first top sections and can be removed without removing said first top sections.

7. The table assembly of claim 1 wherein said impeller comprises:

(a) a body having a leading edge which engages material being crushed;

(b) an attachment mechanism which attaches said impeller releasably to a mounting bracket; and (c) one or more elongate rods which are made from material which is harder than the material said body is made from, said rods being embedded vertically in said body at selected locations near said leading edge.

8. The table assembly of claim 7 wherein there are two rods, one located near each side of said impeller.

9. The table assembly of claim 8 wherein there are three of said rods, one being located near each side of said impeller and one being located proximate the center of said impeller.

10. The table assembly of claim 8 wherein said body is made from cast iron and said rods are made from tungsten carbide.

11. The table assembly of claim 7 including cavities located in said impeller at the leading edge thereof.

12. The table assembly of claim 9 wherein said rods are made from Grade 368 tungsten carbide.

13. The table assembly as in claim 1, wherein the engagement between each respective tab and respective cut-out portion prevents the respective bottom wear plate from moving radially as the table is rotated.

14. An impeller for a vertical shaft centrifugal impact crusher comprising:

(a) a body having a leading edge which engages material being crushed, the leading edge including:

a cut-out portion for engaging a tab on a bottom wear plate of a rotatable table, thereby causing the body of the impeller associated with the leading edge to hold down onto the table the bottom wear plate as the table is rotated;

(b) an attachment mechanism which attaches said impeller releasably to a mounting bracket; and (c) one or more elongate rods which are made from material which is harder than the material said body is made from, said rods being embedded vertically in said body at selected locations near said leading edge.

15. The impeller of claim 14 wherein there are two of said rods, one located near each side of said impeller.

16. The impeller of claim 15 wherein there are three of said rods, one being located near each side of said impeller and one being located proximate the center of said impeller.

17. The impeller of claim 14 wherein said body is made from cast iron and said rods are made from tungsten carbide.

18. The impeller of claim 17 wherein said rods are made from Grade 368 tungsten carbide.

19. The impeller of claim 14 including cavities located in said impeller at the leading edge thereof.

20. The impeller of claim 14, wherein the engagement between the tab and the cut-out portion prevents the bottom wear plate from moving radially as the table is rotated.

* * * * *